United States Patent [19]

Paris et al.

[11] Patent Number: 5,031,341

[45] Date of Patent: Jul. 16, 1991

[54] REAR-ENTRY SKI BOOT

[75] Inventors: Jean Paris, Sevrier; Jean-Marie Begey, Bonne, both of France

[73] Assignee: Salomon S.A., Annecy Cedex, France

[21] Appl. No.: 449,800

[22] Filed: Dec. 13, 1989

[30] Foreign Application Priority Data

Dec. 13, 1988 [FR] France ..... 88 16400
Sep. 13, 1989 [FR] France ..... 89 11991

[51] Int. Cl.[5] ..... A43B 5/04
[52] U.S. Cl. ..... 36/121; 36/120
[58] Field of Search ..... 36/117-121

[56] References Cited

U.S. PATENT DOCUMENTS

| | | | |
|---|---|---|---|
| 3,543,421 | 12/1970 | Ader | 36/121 |
| 4,173,084 | 11/1979 | Kirsch | 36/121 |
| 4,494,324 | 1/1985 | Spademan | 36/119 |
| 4,501,078 | 2/1985 | Kopp | 36/121 |
| 4,565,017 | 1/1986 | Ottieri | 36/119 X |
| 4,575,957 | 3/1986 | Petrini | 36/121 |
| 4,677,769 | 7/1987 | Ahmad et al. | 36/117 |
| 4,793,076 | 12/1988 | Hilgarth | 36/120 X |

FOREIGN PATENT DOCUMENTS

| | | | |
|---|---|---|---|
| 296820 | 2/1972 | Austria . | |
| 0119566 | 9/1984 | European Pat. Off. . | |
| 0284978 | 10/1988 | European Pat. Off. | 36/117 |
| 0286586 | 10/1988 | European Pat. Off. | 36/117 |
| 2808805 | 9/1979 | Fed. Rep. of Germany | 36/121 |
| 2454767 | 12/1980 | France | 36/117 |
| 2473856 | 7/1981 | France . | |
| 2498431 | 7/1982 | France | 36/120 |
| 2547175 | 12/1984 | France | 36/117 |

OTHER PUBLICATIONS

A copy of the French Search Report of French Appln. No. 88. 16400.

A copy of the German abstract of German Appln. No. 8001170 (3/18/82).

*Primary Examiner*—David T. Fidei
*Assistant Examiner*—Ted Kavanaugh
*Attorney, Agent, or Firm*—Sandler, Greenblum & Bernstein

[57] ABSTRACT

An alpine ski boot having includes a shell base and an upper journalled at least in one part on the shell base. Between the upper and the shell base a support is provided, itself being journalled on the shell base about a generally horizontal and transverse axis. The upper is journalled on the support about an axis separate from the aforementioned axis. Further, the boot includes a latching device to immobilize the support and, consequently, the journal axis of the upper on the support in a first upper position for skiing and to free the support, during removal, so as to permit a pivoting of the support with respect to the base, about its axis, towards a second lower position, leading to a displacement towards the rear, and possibly downwardly, of the journal axis of the upper on the support.

25 Claims, 7 Drawing Sheets

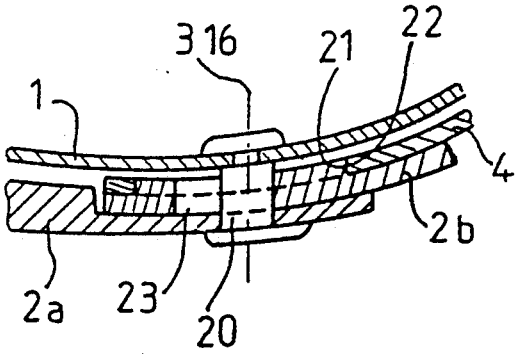
Fig. 22
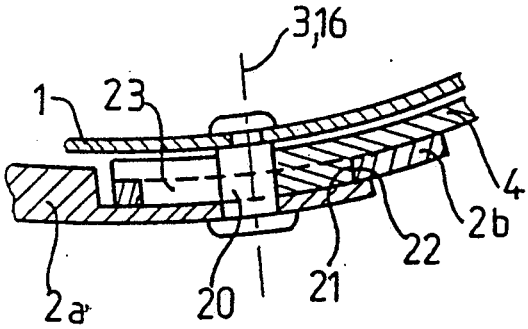
Fig. 21
Fig. 20
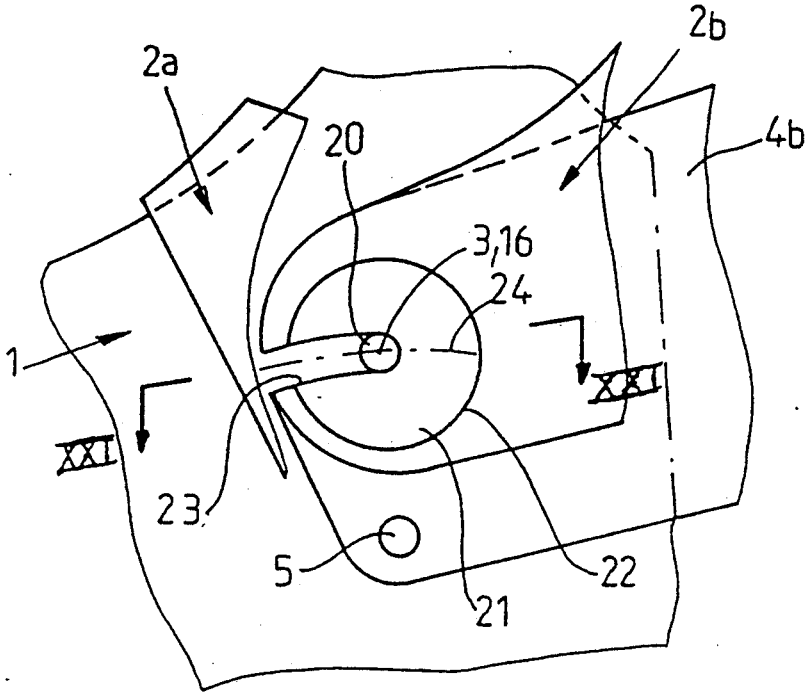

REAR-ENTRY SKI BOOT

BACKGROUND OF THE INVENTION

1. Field of the Invention

The present invention relates to an alpine ski boot of the "rear entry" type, comprising a rigid shell base and an upper journalled on the shell base, about a generally horizontal and transverse axis.

2. Discussion of Background Information

In alpine ski boots of the rear entry type having a journalled upper, the axis about which the upper pivots, must be located relatively close to the ground, for obvious reasons of kinematics, so as to facilitate to the maximum the entry of the foot into the boot. Since in most instances this axis also serves as a flexion axis for the upper during skiing, the correspondence between this axis and the ankle joint of the skier is not ensured.

To resolve this problem, there has been provided, in certain alpine ski boots having an upper journalled in two parts, i.e., by means of a front cuff and a rear spoiler, two journal axes. One axis is provided for the front cuff, located in the area of the malleolus of the skier, and another axis is provided for the rear spoiler, located in the lower area of the heel. Such a boot is described for example, in the European Patent No. A-O 119 566. With such a boot, during skiing, the two axes work simultaneously and constitute journal points for the front cuff and the rear spoiler which then move in the same manner as the two sides of a deformable parallelogram. However, such a displacement translates into a translational movement of the front cuff and the rear spoiler with respect to the leg, thus causing irritating friction on the lower leg.

SUMMARY OF THE INVENTION

It is an object of the present invention to provide a rear-entry ski boot having a shell base, an upper having at least one part being mounted to pivot with respect to the shell base about a first axis, a support positioned between the upper and the shell base, the support being mounted to pivot about a generally horizontal transverse second axis separate from the first axis, and means for latching the support and, consequently, the first axis in a first upper skiing position, the latching means being selectively actuatable to release the support from the first upper skiing position, to release the support, during removal of a foot from the boot, for pivoting of the support about the second axis towards a second lower position, thereby at least rearwardly moving the first axis.

In one aspect of the invention, the shell base includes a rear wall, and the support includes a stirrup encircling a rear portion of the shell base, the stirrup including (i) a rear member which is located slightly above the rear wall of the shell base and partially covering the rear wall of the shell base, and (ii) two lateral arms which extend forwardly and which are inclined from top to bottom and from rear to front in the first skiing position.

In another aspect of the invention, each of the lateral arms of the stirrup is connected, at a respective front part thereof, to the shell base by means of a projection delimiting the second axis, the projections being coaxial, or generally coaxial, and each lateral arm being connected to a lateral lower part of the upper by means of a projection delimiting the journal axis of the upper.

The latching device immobilizes the stirrup in the upper skiing position.

In a specific embodiment of the invention, the rear wall of the shell base includes an upper rearward edge, and the latching device includes a pawl journalled on the rear member of the stirrup, exteriorly of the rear member, about a generally horizontal and transverse axis, the pawl being generally L-shaped having a lower arm which extends through the rear member of the stirrup and which can be placed, in the upper skiing position, slightly above the upper edge of the rear wall of the shell base, so as to abut against the edge.

In a further aspect of the invention, the latching means is carried by the stirrup and includes a member which is elastically biased toward the rear wall of the shell base by means of a spring for engagement in a recess of the rear wall. In one embodiment, the member is mounted on the rear member of the stirrup. In another embodiment, the member is mounted on at least one of the lateral arms of the stirrup.

In an additional aspect of the invention, means are provided for adjusting the angular position of the upper relative to the sole of the boot, the adjusting means being positioned between the upper and the rear member of the stirrup.

In a still further aspect of the invention, the rear member of the stirrup includes a rearwardly extending lip, and the adjusting means includes a lug extending rearwardly from the rear wall of the upper, the lug having a threaded hole within which the screw is received, the screw having a head accessible from the top, the screw having a lower end resting on the lip of the rear member of the stirrup.

According to a still additional aspect of the invention, means are provided for controlling the stiffness of the upper in front flexion, the controlling means being mounted between the rear wall of the upper and the rear member of the stirrup.

In another embodiment of the invention, the shell base includes a front upper inclined wall and a pair of sides, and the support includes a stirrup including a front member, extending above the front upper inclined wall of the shell base and, along each side of the shell base, a front lateral arm and a rear lateral arm, the front lateral arm and the rear lateral arm along each side of the shell base forming a V having an apex and forming an obtuse angle open upwardly and which is journalled, proximate the apex, on the shell base, about the second axis, the upper being journalled on each rear lateral arm of the stirrup about the first axis.

Additionally according to this embodiment, the latching means includes a portion which cooperates with the front member of the stirrup and which is affixed to the front upper inclined wall of the shell base.

Still further according to the present invention, the second axis is located forwardly of the first axis.

In addition, the first axis is located, at least in the upper skiing position, above the second axis.

In a specific embodiment of the invention, the upper includes a front cuff and a rear spoiler, the rear spoiler is journalled on the support about the first axis, and the front cuff is not journalled on the support.

Additionally according to this embodiment, the front cuff includes a lower part, wherein the front cuff is journalled, at the lower part, directly on the shell base, about an independent third axis, and, in the upper skiing position, the first axis and the third axis are coaxial, or generally coaxial, and are located generally at the level of the joint of the skier's ankle when the foot is positioned within the boot.

Still further, the rear spoiler includes a circular opening, the boot further includes a cylindrical boss having a circular cross-section centered on the third axis for journalling the rear spoiler and the support, the boss being integral with the support and engages with the circular opening of the rear spoiler, the boss includes a slot extending through the boss, the third axis for the front cuff is delimited by a projection which extends through the slot of the boss and which constitutes, in cooperation with an end of the slot, an abutment which limits, at least in one direction, the extent of angular movement of the support about the second axis. Alternatively, the boss can be integral with the rear spoiler and engages with the circular opening which is located in the support.

In one variation, the slot extends forwardly and rearwardly and includes a closed forward end and a closed rearward end.

In another variation, the rear spoiler includes a front edge and each of the lateral wings includes a front edge, and the slot extends forwardly and rearwardly and includes a forward end which opens into the front edge of the lateral wing and the front edge of the rear spoiler.

Additionally, the slot extends along an arc of a circle which passes through the third axis and which is centered on the second journal axis of the support on the shell base, and the slot has a width substantially equal to the width of the projection delimiting the first journal axis.

According to another embodiment of the invention, the front cuff is affixed to the shell base by means of a flexion zone, and the rear spoiler is journalled alone on the support about the first axis.

In another aspect of the invention, means are provided for limiting the angular movement of the support in either of two directions.

More specifically, the lateral arm includes an arc-shaped slot, in which the arc is centered on the second axis, and the limiting means includes a projection solidly affixed to the shell base and which is engaged in the arc-shaped slot.

According to another object of the invention, the boot includes a shell base; an upper having at least one part being mounted to pivot with respect to the shell base selectively at least about (i) a first axis and (ii) a second axis; and means for enabling the upper to be selectively positioned between a skiing position and a foot insertion/removal position, the boot is movable toward the foot insertion/removal position by pivoting of the upper at least about the second axis.

According to one aspect of the invention, the aforementioned part of the upper is mounted to pivot with respect to the shell base selectively about (i) a first axis and (ii) the first axis and the second axis, the boot is movable about both the first axis and the second axis in the foot insertion/removal position.

According to a specific aspect of the invention, the enabling means includes a latch.

More specifically, the aforementioned part of the upper is movable rearwardly from the skiing position to the foot insertion/removal position, the latch is selectively movable between an engagement position and a release position, in the engagement position the latch prevents the part of the upper from movement to the foot insertion/removal position.

Further according to the invention, a support is provided which is pivotably mounted to the shell base about the second axis, the second axis being positioned forwardly of the first axis, the part of the upper is pivotably mounted on the support about the first axis.

Still further according to the invention, the latch includes an elastically biased member mounted on the support for selective engagement and disengagement with a complementary recess in the shell base.

In a specific embodiment of the invention, the upper includes a rear spoiler, and the upper further includes a front cuff.

Further according to the invention, means are provided for journalling the rear spoiler about the first axis, the front cuff not being mounted about the first axis by the means for journalling.

Additionally according to the invention, the rear spoiler is mounted to pivot about the first axis and the front cuff is mounted to pivot about a third axis. The first axis and the third axis are coaxial in the skiing position of the upper, and the first axis moves rearwardly with respect to the third axis as the upper moves toward the foot insertion/removal position.

BRIEF DESCRIPTION OF THE DRAWING

There will be described below, by way of non-limiting examples, various embodiments of the present invention, with reference to the annexed drawing in which:

FIG. 20 is an elevation view, partially cut-away, on an enlarged scale, of the linkage zone between the rear spoiler and the support of the spoiler, and between the cuff and the shell base, in the case of an alternative embodiment of the boot of FIG. 12;

FIG. 21 is a sectional view along line XXI—XXI of FIG. 20; and

FIG. 22 is a sectional view, on an enlarged scale, similar to that of FIG. 14, in the case of an alternative embodiment of the linkage zone between the rear spoiler and its support.

DETAILED DESCRIPTION OF THE PREFERRED EMBODIMENTS

The present invention is provided to overcome the disadvantages of alpine ski boots known today and, particularly, with regard to boots having two journal axes for the upper. The boot of the invention, described by way of specific embodiments below, achieves this objective by virtue of a particularly simple and efficient design of the assembly which provides the journalled relationship between the upper of the boot and shell base.

To this end, the alpine ski boot of the present invention includes a shell base and an upper journalled at least in one part on the shell base. Between the upper and the shell base a support is provided, itself being journalled on the shell base about a generally horizontal and transverse axis. The upper is journalled on the support about an axis separate from the aforementioned axis. Further, the boot includes a latching means to immobilize the support and, consequently, the journal axis of the upper on the support in a first upper position for skiing and to free the support, during removal, so as to permit a pivoting of the support with respect to the shell base, about its axis, towards a second lower position, leading to a displacement towards the rear, and possibly downwardly, of the journal axis of the upper on the support.

Figure 1:
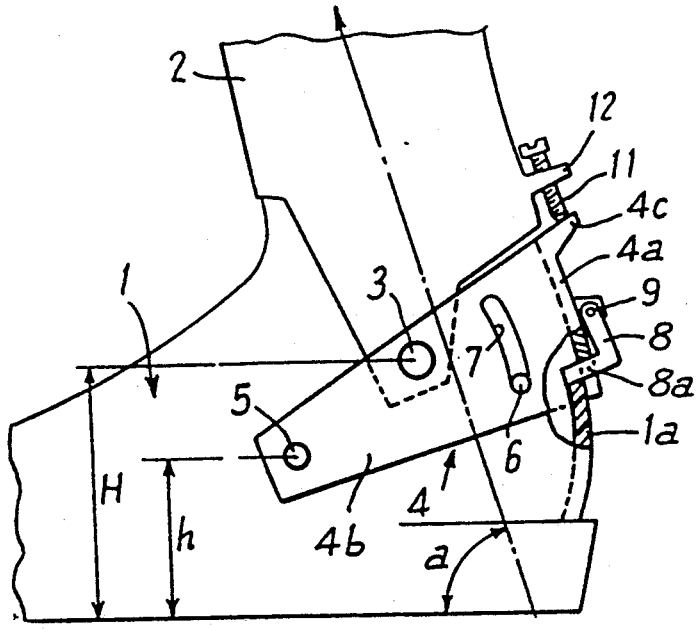
FIG. 1 is a partial elevation view of an alpine ski boot with an upper journalled according to the invention, in normal skiing position.
Figure 2:
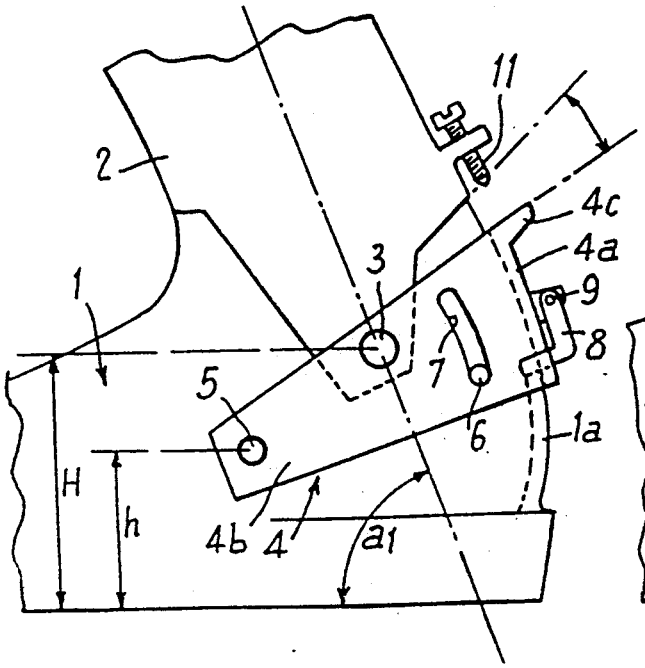
FIG. 2 is an elevation view of the boot of FIG. 1, with its upper in a position flexed towards the front.
Figure 3:
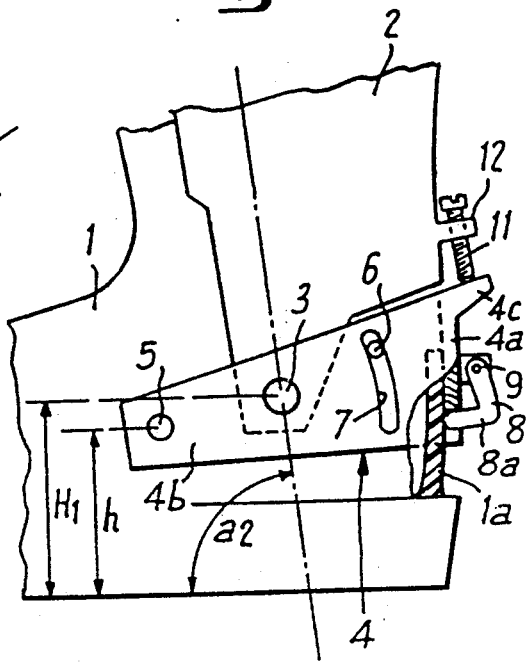
FIG. 3 is a partial elevation view of the ski boot of FIG. 1 with its upper in open position for insertion and removal of the foot.

The alpine ski boot of the present invention, as shown in FIGS. 1-3, includes a rigid shell base 1 and a journalled upper 2, the upper, in this non-limiting embodiment, being constituted as a single piece. According to the invention, upper 2 is journalled, at its lower part, about a generally horizontal and transverse axis 3, on a support 4 which is itself journalled, at its front part, on shell base 1, about a generally horizontal and transverse axis 5 located in front of axis 3. In the skiing position, as is shown in FIGS. 1 and 2, the journal axis 3 of upper 2 on support 4 is located at a height H, with respect to the lower surface of the boot sole, which is greater than the constant height h of journal axis 5 of support 4 on shell base 1 with respect to this same lower surface of the sole. In this embodiment, support 4 is constituted by a stirrup encircling the rear of shell base 1 and, more particularly, the stirrup 4 includes a rear member 4*a* which is located just above the rear wall of shell base 1, while partially covering the latter, and two lateral arms 4*b* which extend towards the front and which are inclined from top to bottom and from rear to front in skiing position shown in FIGS. 1 and 2. Each of the lateral arms 4*b* of stirrup 4 is connected, in its extreme front part, to shell base 1, by means of a journal pin, such as a rivet, which delimits transverse journal axis 5, the two journal pins 5 being coaxial. Each lateral arm 4*b* is likewise connected to a lateral lower part of upper 2, by means of a projection delimiting the journal axis 3 of the upper.

The stirrup 4 constituting the support for upper 2 can pivot through a certain angle about journal axis 5, between an upper skiing position, shown in FIGS. 1 and 2, and a lower insertion-removal position, shown in FIG. 3. This angular movement is limited in the two directions by an abutment device and this device can include, for example, a projection 6 solidly affixed to shell base 1 and which is engaged in an arc-shaped slot 7 which is provided in the lateral arm 4*b* of stirrup 4 while being centered on journal axis 5. However, the reverse arrangement can also be adopted, i.e., by providing projection 6 on lateral arm 4*b* of stirrup 4, this projection 6 being positioned in an arc-shaped channel or groove provided in the lateral wall of shell base 1.

A latching device is provided to immobilize the stirrup 4 in its upper skiing position. This latching device can include, for example, a pawl 8 journalled on member 4*a* of stirrup 4, on the exterior thereof, about a generally horizontal and transverse axis 9. The pawl is generally L-shaped, having a lower arm 8*a*, which extends through member 4*a* of stirrup 4 and which can be placed, in the upper skiing position, just above the upper edge of the rear wall of shell base 1, so as to abut against this edge. As a result, pawl 8 is normally opposed to any downward pivoting movement of stirrup 4.

In the normal skiing position, upper 2 has a certain frontward inclination with respect to the horizontal plane, this inclination corresponding to angle a shown in FIG. 1. This inclination of upper 2 can be selectively adjusted by means of an adjustment device inserted between the upper 2 and the rear member 4*a* of stirrup 4. The adjustment device can be constituted, in this non-limiting embodiment, by a screw 11 which mates with a threaded hole provided in a lug 12, the screw extending downwardly along the rear wall of upper 2, and having a head which is accessible from the top. The lower end of the screw 11 rests on a lip 4*c* projecting towards the exterior, which is provided at the upper end of member 4*a* of stirrup 4. During skiing, stirrup 4 is maintained latched in the upper position, by means of pawl 8 resting, by its lower arm 8*a*, on the upper edge of rear wall 1*a* of shell base 1. Upper 2 can flex more or less towards the front, during skiing, as is shown in FIG. 2, where it is seen that upper 2 is inclined towards the front by an angle greater than angle a, corresponding to the normal position shown in FIG. 1, and in which upper 2 is rearwardly supported on stirrup 4, by means of screw 11.

When the skier wants to remove the boot, he or she merely releases stirrup 4, by retracting the pawl 8 towards the exterior, so that the stirrup 4 is then freed to pivot downwardly, in its lower insertion-removal position shown in FIG. 3. This downward pivoting movement is limited by projection 6 coming into contact with the upper end of arc-shaped slot 7. In this lower position of stirrup 4, journal axis 3 of upper 2 on stirrup 4 is lowered to a height H1, with respect to the lower surface of the boot sole, which is just slightly greater than the height h of journal axis 5 of stirrup 4 with respect to this same lower surface. However, height H1 could also be equal to, or slightly less than, fixed height h. The lowering of journal axis 3 of upper 2 then facilitates the removal and final re-insertion since in this position, upper 2 extends almost vertically, i.e., its axis forms with the horizontal an angle a2 close to 90°.

It can be seen in FIG. 3 that in the lower release position, the lower horizontal arm 8*a* of pawl 8, which has been pushed towards the exterior, rests against the rear wall 1*a* of shell base 1. Pawl 8 is biased by a spring not shown which constantly pushes arm 8*a* against wall 1*a* of shell base 1 so that, when the skier pivots stirrup 4 again towards its upper skiing position, about axis 5, pawl 8 engages automatically, by its arm 8*a*, above the upper edge of rear wall 1*a* of shell base 1, while thus automatically again ensuring the latching of stirrup 4 in the upper skiing position.

Figure 4:
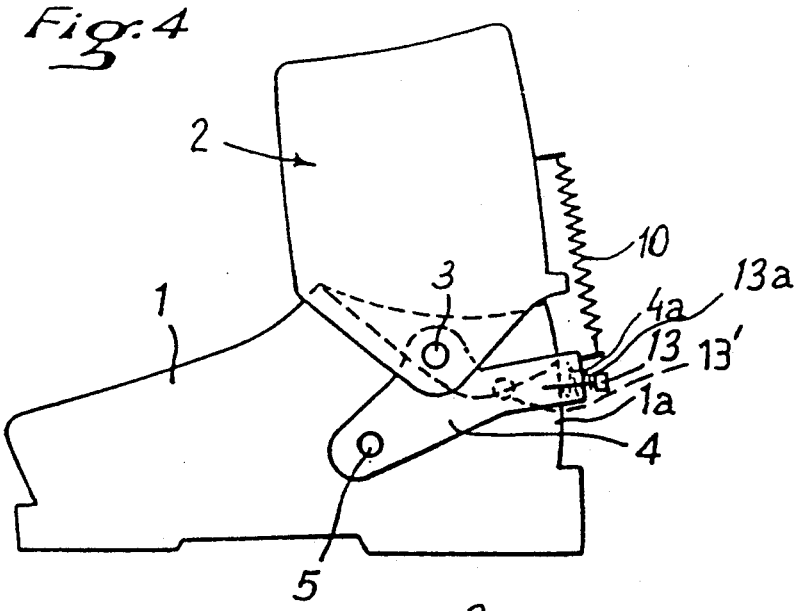
FIGS. 4, 5, and 6 are elevation views of various alternative embodiments of the alpine ski boot according to the invention.

In the alternative embodiment shown schematically in FIG. 4, stirrup 4 supports a latch 13 of the pusher type, such as a spring-biased pin, in which the spring, e.g., could comprise a coil spring 13*a* surrounding the pin on or in stirrup 4, to elastically bias the pin in the direction of the rear wall 1*a* of shell base 1, so as to engage the pin in a recess formed in wall 1*a*. Pusher 13 can be slidably mounted either in rear member 4*a* of stirrup 4, as is shown in FIG. 4, or in a lateral arm 4*b* of stirrup 4, shown in dashed lines as 13'. Moreover, a device 10 for controlling the stiffness of upper 2 in front flexion is mounted between the rear wall of this upper 2 and rear member 4*a* of stirrup 4.

Figure 5:
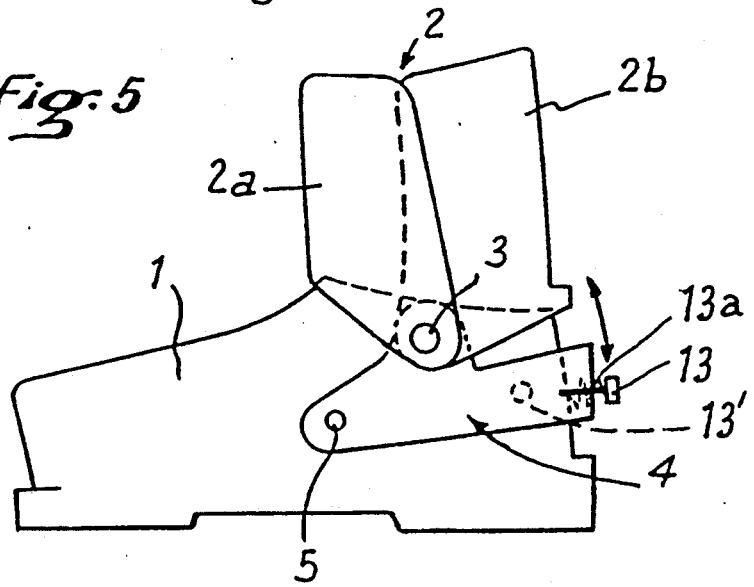

FIG. 5 illustrates the application of the invention to an alpine ski boot whose upper 2 is constituted by two parts, a front cuff 2*a* and a rear spoiler 2*b*, these two parts being journalled together on stirrup 4 about common axis 3.

Figure 6:
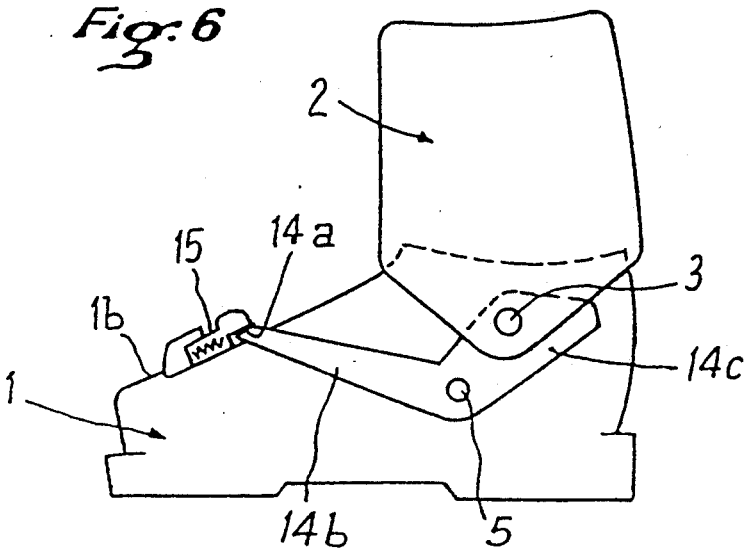

In the alternative embodiment shown in FIG. 6, the alpine ski boot comprises a stirrup 14 which is formed in a different manner from the foregoing embodiments, in that it does not encircle the rear of shell base 1, but extends above the front part thereof. In this case, stirrup 14 includes a front member 14*a*, extending above the front and upper inclined wall 1*b* of shell base 1, and on each side of shell base 1, a front lateral arm 14*b* and a rear lateral arm 14*c*, these two lateral arms 14*b*, 14*c* forming a V of an obtuse angle open towards the top and which is journalled, at the location of its apex, on shell base 1, about axis 5. Upper 2 is journalled on each rear lateral arm 14*c* of stirrup 14, about axis 3, which is located above and rearward of journal axis 5 of stirrup 14 on shell base 1. The latching of stirrup 14 in the skiing position is achieved by means of a latching device 15 which cooperates with member 14*a* of stirrup 14, and which is affixed to the inclined upper wall 1*b* of shell base 1. As shown in FIG. 6, the latching device 15 includes a manually activated spring-biased slidable projection which overlies the front stirrup member 14*a* in the skiing position. Alternatively, the spring-biased latching projection could itself be positioned on the front stirrup member 14*a* for latching engagement with a raised abutment located on the upper wall 1*b*. During skiing, therefore, the rear arm 14*c* is maintained, by the latching device 15, in the upper position, as is journal axis 3 of upper 2 on stirrup 14. The rear arm 14*c* is lowered, together with journal axis 3, when stirrup 14 is released, in the insertion-removal position.

Figure 7:
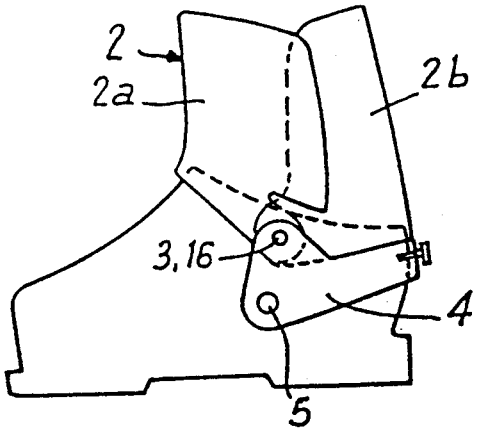
FIGS. 7 and 8 are elevation views of another alternative embodiment of an alpine ski boot, in the skiing position and the insertion-removal position, respectively.
Figure 8:
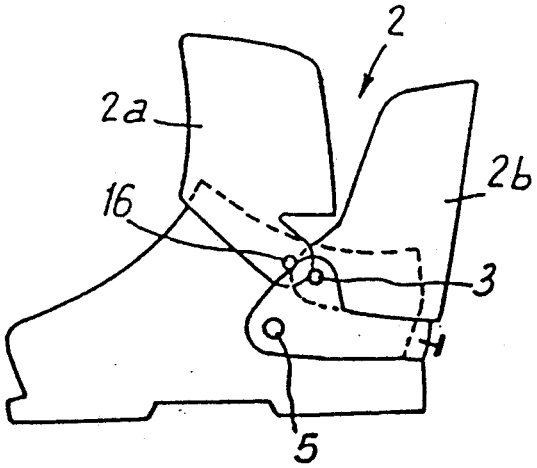

In the alternative embodiment shown in FIGS. 7 and 8, the ski boot comprises an upper 2 made of two parts, namely a front cuff 2*a* and a rear spoiler 2*b*. In the illustrated embodiment, only the rear spoiler 2*b* is journalled on stirrup 4, about axis 3. The front cuff 2*a* is itself journalled, at its lower part, directly on shell base 1, about a fixed independent axis 16. In the skiing position, as is shown in FIG. 7, the two axes 3, 16 are coaxial, or generally coaxial, and are located generally in the area of the pivoting of the skier's ankle and, as a result, the boot upper 2 pivots with respect to the shell base about a single axis 3, 16. In insertion-removal position, i.e., when stirrup 4 has pivoted in its lower position, front cuff 2*a* remains in its position on shell base 1 when rear spoiler 2*b* is lowered towards the rear, which facilitates insertion and removal, as shown in FIG. 8.

Figure 9:
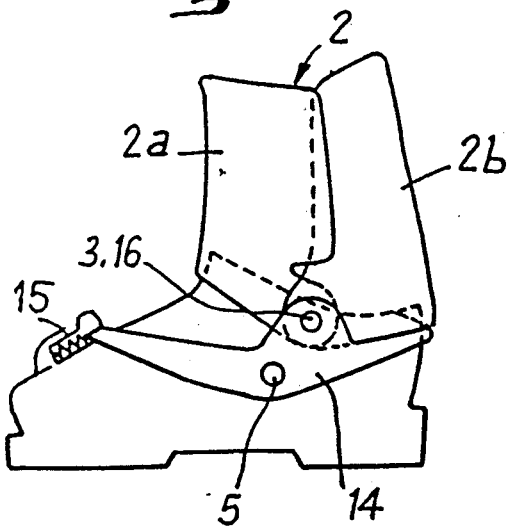
FIGS. 9 and 10 are schematic elevation views of another alternative embodiment of an alpine ski boot according to the invention, in the skiing position and the insertion-removal position, respectively.
Figure 10:
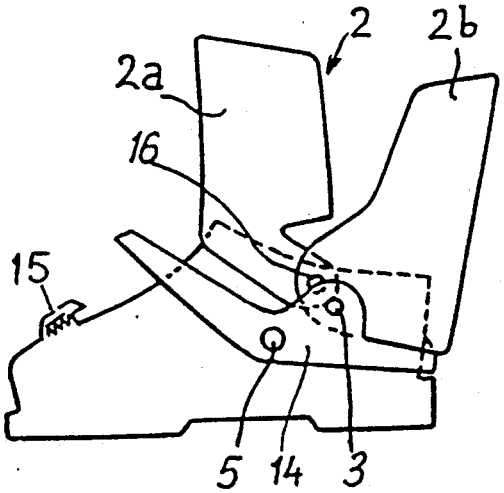

FIGS. 9 and 10 show an alternative embodiment of the alpine ski boot illustrated in FIG. 6, but in this case, upper 2 is made in two parts, namely a front cuff 2*a* and a rear spoiler 2*b*, as in the immediately preceding embodiment. Front cuff 2*a* is journalled on shell base 1, about axis 16, whereas rear spoiler 2*b* is independently journalled on stirrup 14 and, more particularly, on rear lateral arm 14*c* of the stirrup, about axis 3. In the skiing position, as is shown in FIG. 9, the two axes 3, 16 are coaxial, or generally coaxial, whereas in the insertion-removal position, as is shown in FIG. 10, axis 3 is lowered with respect to axis 16, which itself is fixed and rear spoiler 2*b* is pivoted downwardly and towards the rear.

Figure 11:
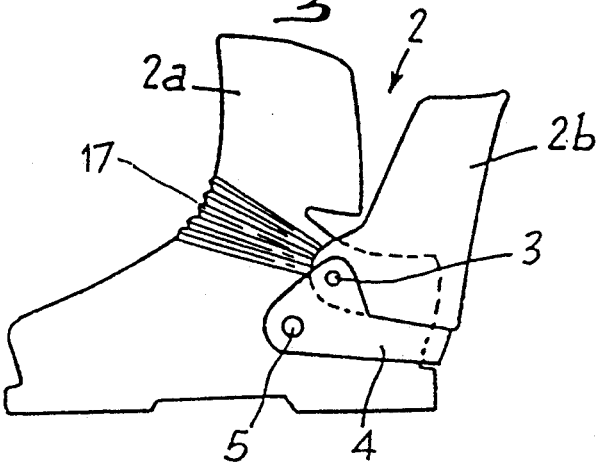
FIG. 11 is an elevation view of another alternative embodiment of an alpine ski boot according to the invention with a pivotable rear spoiler, in the insertion-removal position.

FIG. 11 illustrates the application of the invention to a ski boot in which upper 2, made in two parts, includes a front cuff 2*a* which is integrally affixed to shell base 1, by means of a flexion device 17, and a rear spoiler 2*b* which can pivot about axis 5. In this case, rear spoiler 2*b* is separately journalled on stirrup 4 about axis 3.

In the alternative embodiment illustrated in FIGS. 12–18, the boot includes a rigid shell base 1 and a journalled upper 2 which is made in two parts, namely a front cuff 2*a* and a rear spoiler 2*b*. The front cuff 2*a* is journalled, at its lower part, directly on shell base about a fixed transverse axis 16 located substantially at the level of the ankle of the skier's foot. Journal axis 16 is embodied as a projection 20 extending through holes provided in shell base 1 and in front cuff 2*a*, these holes possibly having different diameters. At its two ends, projection 20 is provided with heads 20*a* and 20*b* forming rivets located, respectively, within the wall of shell base 1, against this wall, and outside front cuff 2*a*, against the external surface thereof.

Figure 12:
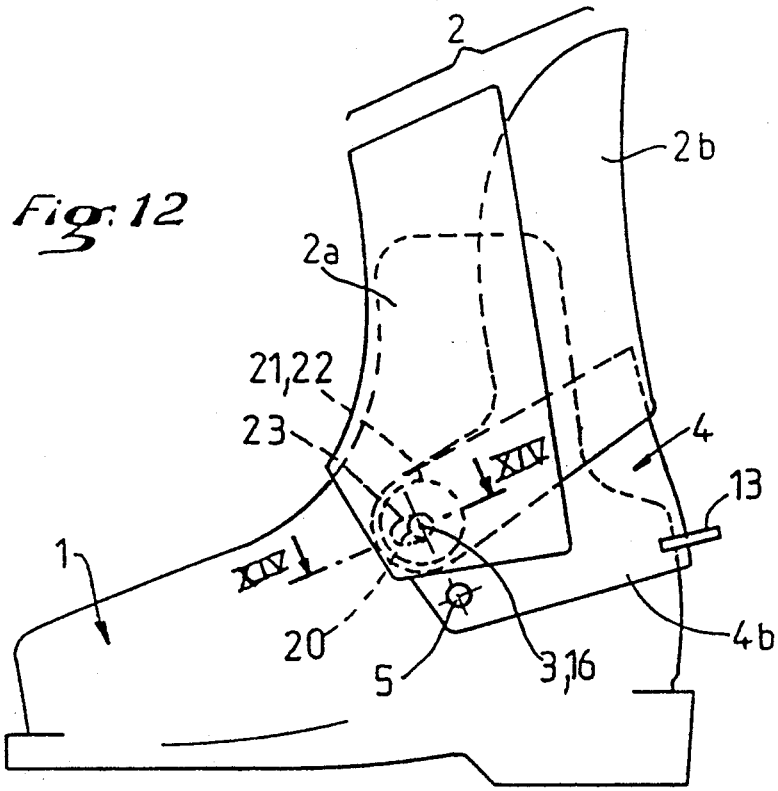
FIG. 12 is an elevation view of another alternative embodiment of an alpine ski boot according to the invention, whose upper is constituted by two separate parts journalled between them, namely a front cuff and a rear spoiler, in the normal skiing position.

Rear spoiler 2*b* of upper 2 is itself journalled about a generally horizontal and transverse axis 3 on support 4, which is itself journalled on shell base 1, at its front and lower part, about a generally horizontal and transverse axis located beneath axis 3. Support 4 has the shape of a stirrup encircling the rear of shell base 1 and includes two lateral wings 4*b* extending towards the front and inclined from top to bottom and from rear to front in the skiing position. Support 4 carries a latching device 13 which is effective to rigidly affix the support stirrup 4 to the shell base 1 during skiing. The latching device 13 can be placed in any appropriate location of the support and it is preferably mounted at the rear, as is shown in FIG. 12.

Figure 13:
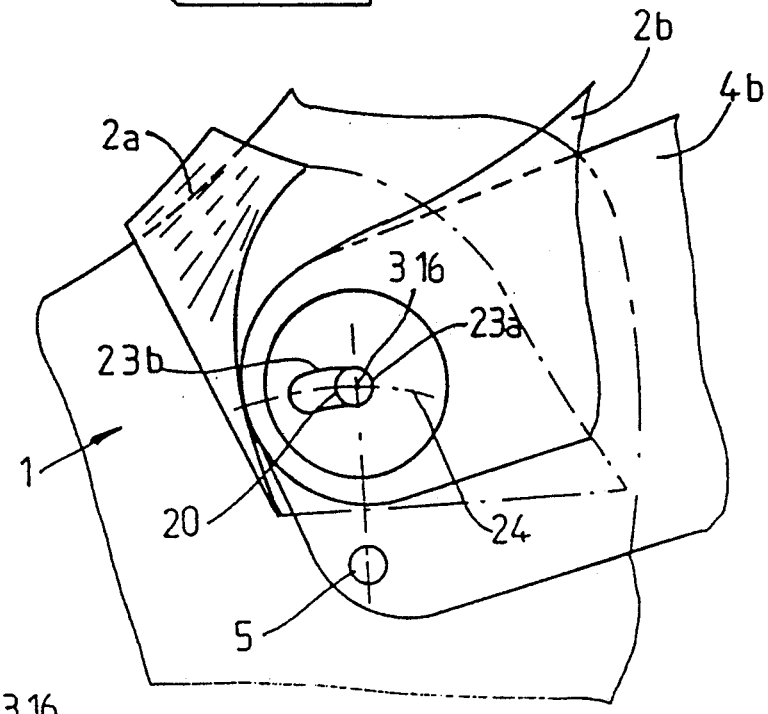
FIG. 13 is an elevation view, partially cut-away, on an enlarged scale, of the linkage zone between the rear spoiler and the support for the spoiler, and between the cuff and the shell base of the boot of FIG. 12.
Figure 14:
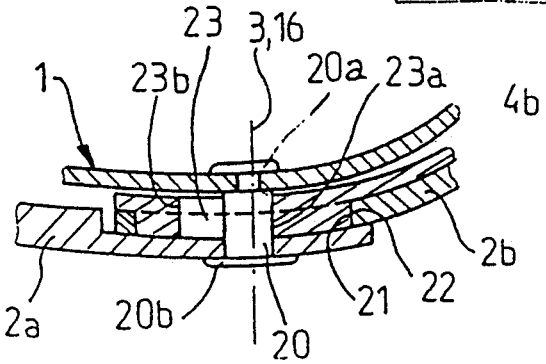
FIG. 14 is a sectional view, on an enlarged scale, along line XIV—XIV of FIG. 12.

As can best be seen in FIGS. 13 and 14, the journalling of the rear spoiler 2*b* with respect to each of the wings 4*b* about transverse axis 3 is achieved by means of a cylindrical boss 21, having a circular cross-section, centered on axis 3, and which is engaged in a circular opening 22, of about the same radius. In the embodiment shown in FIGS. 12–18, the cylindrical boss 21 is an integral part of wing 4*b* of stirrup 4, being unitarily molded therewith for example, and it projects towards the exterior of the wing to engage in the circular opening 22 which is itself provided in a lower front wing of rear spoiler 2*b* which is located on the exterior with respect to stirrup 4.

Projection 20 which delimits journal axis 16 of front cuff 2*a* on shell base 1, passes through a slot 23 which extends completely through the reinforced zone where circular boss 21 is formed, the boss being supported by wing 4*b*. The slot 23 can have any shape and it can particularly have a width substantially equal to the diameter of projection 20 and extends along an arc of a circle 24 which is centered on journal axis 5 of the stirrup forming support 4 on shell base 1 and which passes through axis 3, as can best be seen in FIG. 2. As a result, projection 20 engaged within slot 23 constitutes an abutment which limits, in cooperation with the rear end 23*a* and front end 23*b* of slot 23, the amplitude of angular pivoting movement of stirrup 4 about axis 5.

Figure 15:
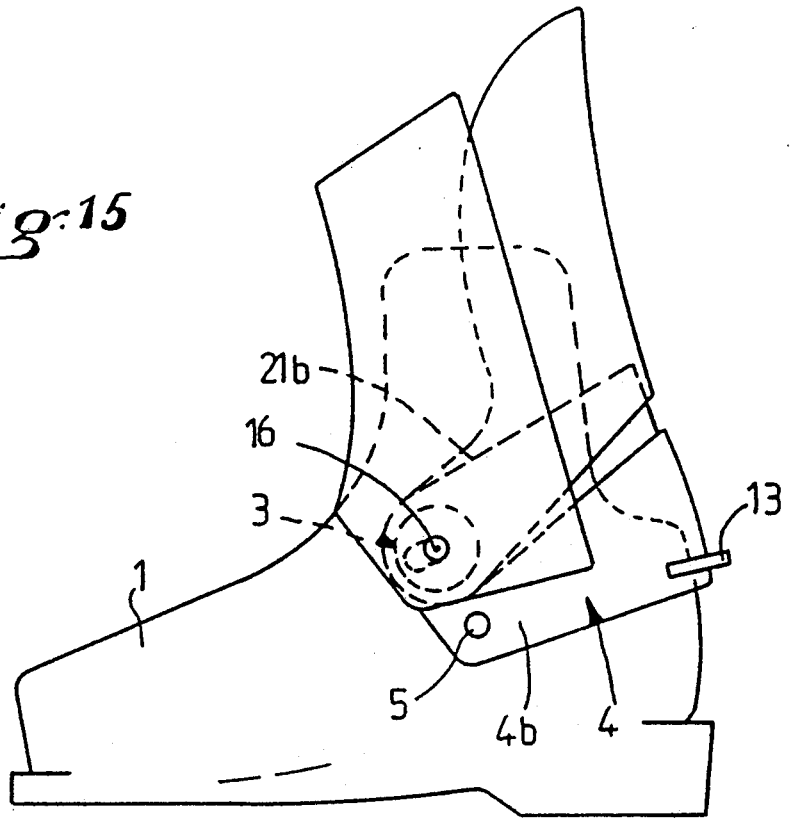
FIG. 15 is an elevation view of the boot of FIG. 13 with its upper in the position of frontward flexion during skiing.

In the skiing position, stirrup 4 is held in the upper position on shell base 1 by means of latching device 13, as is shown in FIGS. 12–15. In this position, rear end 23*a* of slot 23 abuts against projection 20 and journal axis 3 of rear spoiler 2*b* on the stirrup forming support 4 merges with journal axis 16 of front cuff 2*a* on shell base 1, as appears more clearly in FIGS. 2 and 3. As a result, upper 2, which is tightened around the skier's lower leg, can pivot in its entirety about the common transverse journal axis 3, 16 located substantially at the level of the skier's ankle. FIG. 15 shows the position of upper 2 which is further flexed towards the front than the upper shown in FIG. 12.

Figure 16:
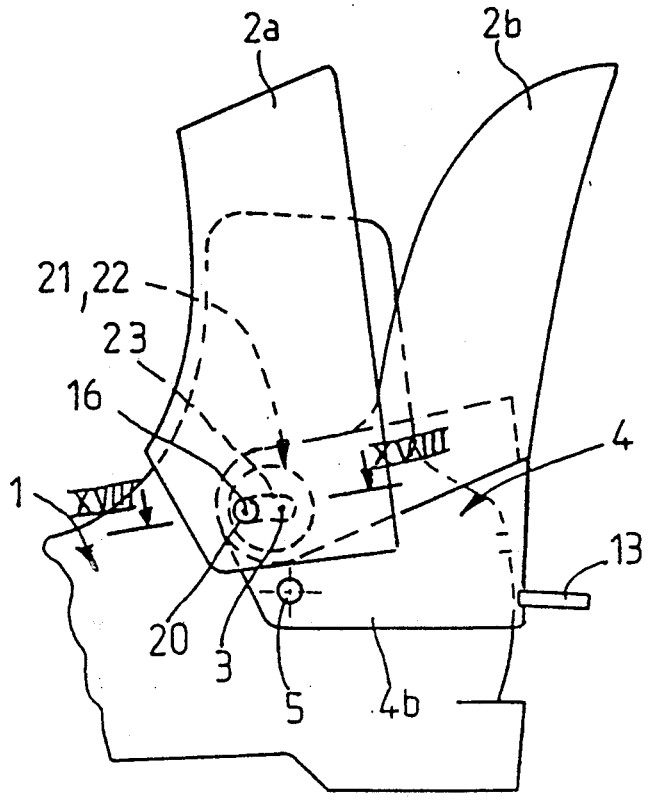
FIG. 16 is an elevation view of the alpine ski boot shown in FIG. 13, with its support pivoted downwardly and its upper in the open position for insertion and removal of the foot.
Figure 17:
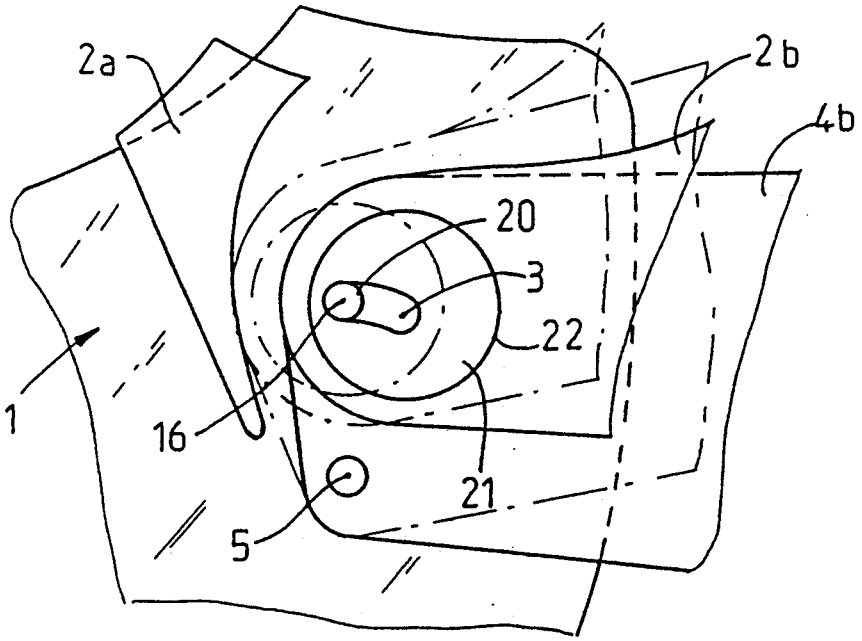
FIG. 17 is an elevation view, partially cut-away, on an enlarged scale, of the linkage zone between the rear spoiler and the support for the spoiler, and between the cuff and the shell base of the boot shown in FIG. 16.
Figure 18:
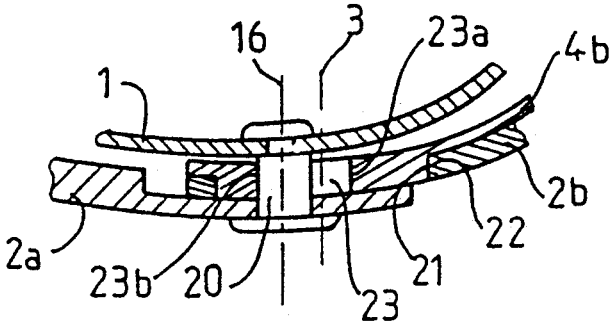
FIG. 18 is a sectional view, on an enlarged scale, along line XVIII—XVIII of FIG. 16.

When the skier wants to remove the boot, he or she unlocks the latching device 13 so as to make the stirrup 4 pivot downwardly about axis 5, to bring it into the position shown in FIG. 16. In the course of this clockwise pivoting movement of stirrup 4 about lower axis 5, slot 23 slides along projection 20 until the front end 23*b* of slot 23 abuts against projection 20, while thus limiting the downward pivoting movement of stirrup 4, as is shown in FIGS. 16, 17, and 18, so that the amplitude of angular clearance of the stirrup 4 is a function of the length of slot 23. In this case, axis 3 of circular boss 21, i.e., the journal axis of rear spoiler 2*b* on the stirrup 4, is offset towards the rear with respect to journal axis 16 of front cuff 2*a* on shell base 1, as can best be seen in FIGS. 17 and 18. This results in the offsetting of the rear spoiler towards the rear, thus facilitating the insertion and removal operation.

Figure 19:
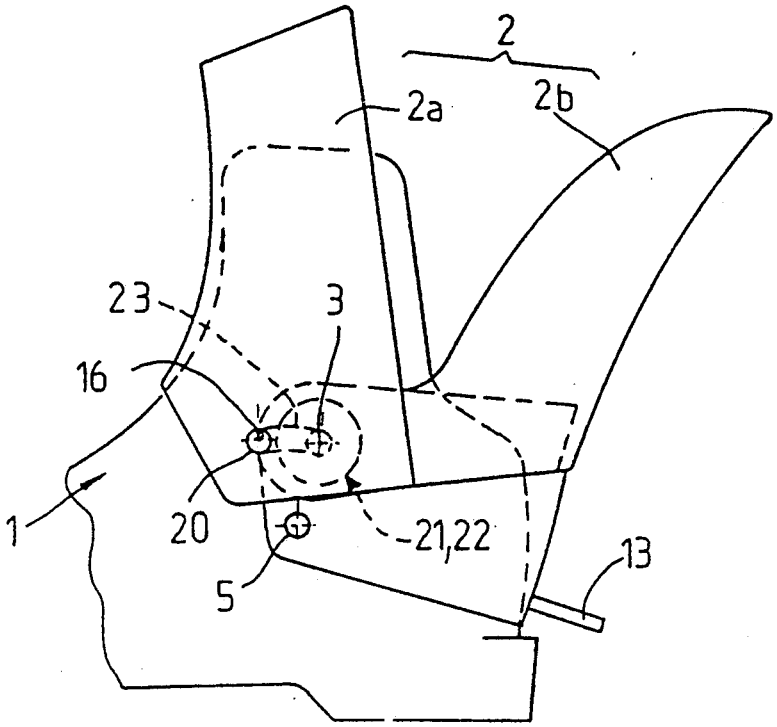
FIG. 19 is an elevation view of an alternative embodiment of the alpine ski boot of FIG. 12, its support being pivoted downwardly and with its upper being in the open position for insertion and removal of the foot.

In the alternative embodiment shown in FIGS. 19, 20, and 21, slot 23 is shown as opening into the front edge of lateral wing 4*b* of the stirrup 4 and into that of rear spoiler 2*b*. This makes it possible to obtain a greater amplitude of clearance of the stirrup 4 downwardly, since projection 20 can then extend completely out of slot 23.

FIG. 22 illustrates an alternative embodiment in which circular boss 21, delimiting the journal axis 3 of rear spoiler 2*b* on the stirrup 4, is provided on the internal surface of the lateral wing of rear spoiler 2*b* and extends towards the interior to tightly engage in a circular opening 22 of the same radius provided in lateral wing 4*b* of stirrup 4.

Although the invention has been described with reference to particular means, materials, and embodiments, it is to be understood that the invention is not limited to the particulars disclosed and extends to all equivalents within the scope of the claims.

What is claimed is:

1. Alpine ski boot of the rear entry type, comprising:

(a) a shell base;

(b) an upper having at least one part being mounted to pivot with respect to said shell base about a first axis;

(c) a support positioned between said upper and said shell base, said support being mounted to pivot about a generally horizontal transverse second axis separate from said first axis; and (d) means for latching said support and, consequently, said first axis in a first upper skiing position, said latching means being selectively actuatable to release said support from said first upper skiing position, to release said support, during removal of a foot from said boot, for pivoting of said support about said second axis towards a second lower position, thereby at least rearwardly moving said first axis.

2. The alpine ski boot according to claim 1, wherein said shell base comprises a rear wall, and wherein said support comprises a stirrup encircling a rear portion of said shell base, said stirrup including (i) a rear member which is located slightly above said rear wall of said shell base and partially covering said rear wall of said shell base, and (ii) two lateral arms which extend forwardly and which are inclined from top to bottom and from rear to front in said first skiing position.

3. The alpine ski boot according to claim 2, wherein each of said lateral arms of said stirrup is connected, at a respective front part thereof, to said shell base by means of a projection through which said second axis extends, and each of said lateral arms being connected to a lateral lower part of said upper by means of a projection through which said journal axis of said upper extends.

4. The alpine ski boot according to claim 2, wherein said latching means comprises means for immobilizing said stirrup in said upper skiing position.

5. The alpine ski boot according to claim 4, wherein said rear wall of said shell base comprises an upper rearward edge, and wherein said latching device comprises a pawl journalled on said rear member of said stirrup, exteriorly of said rear member, about a generally horizontal and transverse axis, said pawl being generally L-shaped having a lower arm which extends through said rear member of said stirrup and which can be placed, in said upper skiing position, slightly above said upper edge of said rear wall of said shell base, so as to abut against said edge.

6. The alpine ski boot according to claim 4, wherein said latching means is carried by said stirrup and comprises a member which is elastically biased toward said rear wall of said shell base by means of a spring for engagement in a recess of said rear wall.

7. The alpine ski boot according to claim 6, wherein said member is mounted on said rear member of said stirrup.

8. The alpine ski boot according to claim 6, wherein said member is mounted on at least one of said lateral arms of said stirrup.

9. The alpine ski boot according to claim 2, further comprising means for adjusting the angular position of said upper relative to the sole of said boot, said adjusting means being positioned between said upper and said rear member of said stirrup.

10. The alpine ski boot according to claim 9, wherein said rear member of said stirrup comprises a rearwardly extending lip, and wherein said adjusting means comprises a lug extending rearwardly from the rear wall of said upper and a screw, said lug having a threaded hole within which said screw is received, said screw having a head accessible from the top, said screw having a lower end resting on said lip of said rear member of said stirrup.

11. The alpine ski boot according to claim 2, further comprising means for controlling the stiffness of said upper in front flexion, said controlling means being mounted between said rear wall of said upper and said rear member of said stirrup.

12. The alpine ski boot according to claim 1, wherein said shell base comprises a front upper inclined wall and a pair of sides, and wherein said support comprises a stirrup comprising a front member, extending above said front upper inclined wall of said shell base and, along each side of said shell base, a front lateral arm and a rear lateral arm, said front lateral arm and said rear lateral arm along each side of said shell base forming a V having an apex and forming an obtuse angle open upwardly and which is journalled, proximate said apex, on said shell base, about said second axis, said upper being journalled on each rear lateral arm of said stirrup about said first axis.

13. The alpine ski boot according to claim 12, wherein said latching means includes a portion which cooperates with said front member of said stirrup and which is affixed to said front upper inclined wall of said shell base.

14. The alpine ski boot according to claim 1, wherein said second axis is located forwardly of said first axis.

15. The alpine ski boot according to claim 1, wherein said first axis is located, at least in said upper skiing position, above said second axis.

16. The alpine ski boot according to claim 1, wherein said upper comprises a front cuff and a rear spoiler, wherein said rear spoiler is journalled on said support about said first axis, and wherein said front cuff is not journalled on said support.

17. The alpine ski boot according to claim 16, wherein said front cuff comprises a lower part, wherein said front cuff is journalled, at said lower part, directly on said shell base, about an independent third axis, and wherein, in said upper skiing position, said first axis and said third axis are coaxial, or generally coaxial, and are located generally at the level of the joint of the skier's ankle when the foot is positioned within said boot.

18. The alpine ski boot according to claim 17, wherein said rear spoiler comprises a circular opening, wherein said boot further comprises a cylindrical boss having a circular cross-section centered on said third axis for journalling said rear spoiler and said support, said boss being integral with said support and engages with said circular opening of said rear spoiler, wherein said boss comprises a slot extending through said boss, wherein said third axis for said front cuff is delimited by a projection which extends through said slot of said boss and which constitutes, in cooperation with an end of said slot, an abutment which limits, at least in one direction, the extent of angular movement of said support about said second axis.

19. The alpine ski boot according to claim 17, wherein said support comprises a circular opening, wherein said boot further comprises at least one cylindrical boss having a circular cross-section centered on said third axis for journalling said rear spoiler and said support, said boss being integral with said rear spoiler and engages with said circular opening of said support, wherein said boss comprises a slot extending through said boss, wherein said third axis for said front cuff is delimited by a projection which extends through said slot of said boss and which constitutes, in cooperation with an end of said slot, an abutment which limits, at least in one direction, the extent of angular movement of said support about said second axis.

20. The alpine ski boot according to claim 18, wherein said slot extends forwardly and rearwardly and comprises a closed forward end and a closed rearward end.

21. The alpine ski boot according to claim 18, wherein said rear spoiler comprises a front edge and each of said lateral wings comprises a front edge, and wherein said slot extends forwardly and rearwardly and comprises a forward end which opens into said front edge of said lateral wing and said front edge of said rear spoiler.

22. The alpine ski boot according to claim 18, wherein said slot extends along an arc of a circle which passes through said third axis and which is centered on said second journal axis of said support on said shell base, and wherein said slot has a width substantially equal to the width of said projection delimiting said first journal axis.

23. The alpine ski boot according to claim 16, wherein said front cuff is affixed to said shell base by means of a flexion zone, and wherein said rear spoiler is journalled alone on said support about said first axis.

24. The alpine ski boot according to claim 1, further comprising means for limiting the angular movement of said support in either of two directions.

25. The alpine ski boot according to claim 24, wherein said at least one of said lateral arms includes an arc-shaped slot, in which said arc is centered on said second axis, and wherein said limiting means comprises a projection solidly affixed to said shell base and which is engaged in said arc-shaped slot.

* * * * *